United States Patent [19]

Zimmerle et al.

[11] 4,207,822

[45] Jun. 17, 1980

[54] HOPPER CAR OUTLET GATE ASSEMBLY

[75] Inventors: James R. Zimmerle, O'Fallon; Thomas B. Baker, St. Charles, both of Mo.

[73] Assignee: ACF Industries, Incorporated, New York, N.Y.

[21] Appl. No.: 902,699

[22] Filed: May 4, 1978

[51] Int. Cl.[2] ..... B61D 7/02; B61D 7/20; B61D 7/26

[52] U.S. Cl. ..... 105/253; 105/282 P; 105/305; 222/506

[58] Field of Search ..... 105/248, 282 A, 282 P, 105/282 R, 284, 250, 253; 222/505, 556, 506

[56] References Cited

U.S. PATENT DOCUMENTS

| | | | |
|---|---|---|---|
| 1,533,862 | 4/1925 | Hyle | 105/248 |
| 2,630,768 | 3/1953 | Dorey | 105/282 P |
| 3,066,618 | 12/1962 | Gunnison | 105/282 P |
| 3,348,501 | 10/1967 | Stevens et al. | 105/248 |
| 3,396,675 | 8/1968 | Stevens | 105/282 P X |
| 3,820,473 | 6/1974 | McNally | 105/282 R X |
| 3,837,294 | 9/1974 | Fossett | 105/282 P X |

*Primary Examiner*—Howard Beltran

*Attorney, Agent, or Firm*—Henry W. Cummings

[57] ABSTRACT

In accordance with the present invention a railway hopper car unloading arrangement is provided, including at least one hopper having hopper slope sheets extending downwardly and inwardly. A standard outlet frame is attached to the inner ends of the hopper slope sheets. A removable adapter is attached to the outlet frame. The adapter includes an adapter mounting flange and a divider extending longitudinally of the car, which divides the adapter into a pair of transversely spaced adapter outlets or chutes. The adapter further includes adapter side walls and end walls, the lower ends of which define transversely spaced adapter chutes. A generally horizontally extending gate is movable between open and closed positions relative to each adapter chute. In addition, the adapter includes boot attachment means located below each adapter outlet for attachment of an unloading boot for each adapter outlet. The adapter is removable from the frame and a standard outlet may be attached to the frame with a single large discharge opening. The adapter boot attachment means may take the form of depending legs having outwardly extending attachment flanges attached to the depending legs.

6 Claims, 6 Drawing Figures

HOPPER CAR OUTLET GATE ASSEMBLY

BACKGROUND OF THE INVENTION

This invention relates to discharge outlets for railway hopper cars.

In U.S. Pat. No. 3,348,501 (1967) assigned to the same assignee as the present application, a railway hopper car discharge outlet is disclosed, including a horizontally moving outlet gate, movable between open and closed positions relative to the outlet discharge opening.

Below the gate a divider and a pair of discharge chutes are mounted to allow discharge of the lading through laterally spaced discharge openings. Some unloading sites have boots which fit these unloading chutes. The pair of discharge chutes can be moved from below the discharge opening by pinions and a rack to discharge the lading through the entire cross-sectional area of the discharge opening. Some unloading sites have boots which fit this larger discharge opening.

However, in either case, the weight of the lading acts on the entire upper surface of the gate in closed position. In order to open the gate the frictional force between the entire upper surface of the gate and the lading must be overcome. This is a large force and in many instances requires considerable opening torque to open the gate. Occasionally it is quite difficult for the operator to open the gate.

In U.S. Pat. No. 1,533,862 (1925) a steel grain car is disclosed having transversely spaced outlets attached to depending flanges of a steel car floor. Each outlet has its own separately operable gravity gate.

However, since the outlets are attached to the car floor, this outlet arrangement is not readily modified to provide a discharge opening having a large cross-sectional area in the lower portion of the hopper for use in services where a large unloading boot is available at the unloading site.

SUMMARY OF THE INVENTION

An object of the present invention is to provide a railway hopper car unloading arrangement in which the force required to open a discharge gate is reduced by reducing the force of lading friction opposing movement of the gate to open position.

Another object of the present invention is to provide a railway hopper car unloading arrangement which is adapted to receive unloading boots of different sizes commonly used in the railway industry.

In accordance with the present invention a railway hopper car unloading arrangement is provided, including at least one hopper having hopper slope sheets extending downwardly and inwardly. A standard outlet frame is attached to the inner ends of the hopper slope sheets. A removable adapter is attached to the outlet frame, including an adapter mounting flange and a divider extending longitudinally of the car, which divides the adapter into a pair of transversely spaced adapter chutes. The adapter further includes adapter side walls and end walls, the lower ends of which define transversely spaced adapter discharge chutes. A generally horizontally extending gate is movable between open and closed positions relative to each adapter discharge opening. In addition, the adapter includes boot attachment means located below each adapter chute for attachment of an unloading boot for each adapter chute. The boot attachment means may take the form of depending legs having outwardly extending attachment flanges attached to the depending legs. Each gate has means attached thereto for moving the gate between open and closed positions. In one form door bearings are attached to one end of the gate and to a transversely extending pinion shaft. The pinion shaft includes pinions which are movable on transversely spaced fixed racks attached to the adapter. In another form transversely spaced racks are attached to one end of the gate and are rotatable, but longitudinally and transversely fixed pinions drive the racks and move the gate between open and closed positions.

The adapter is removable from the outlet frame and a large outlet may be attached to the frame having a large opening occupying substantially the entire cross-sectional area within the frame. This outlet is adapted to receive large unloading boots.

THE DRAWINGS

DESCRIPTION OF PREFERRED EMBODIMENTS

Figure 1:
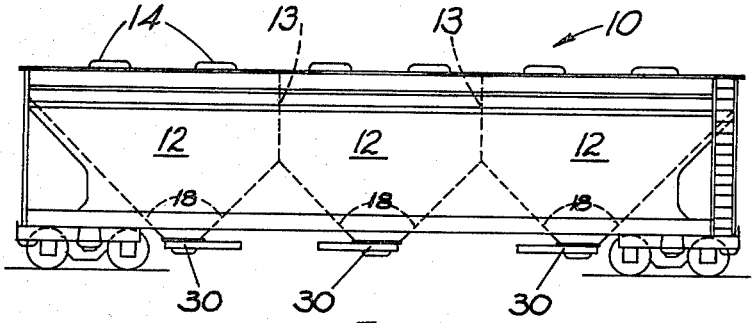
FIG. 1 is a side elevation view of a railway hopper car with which the outlet arrangement of the present invention may be used.
Figure 3:
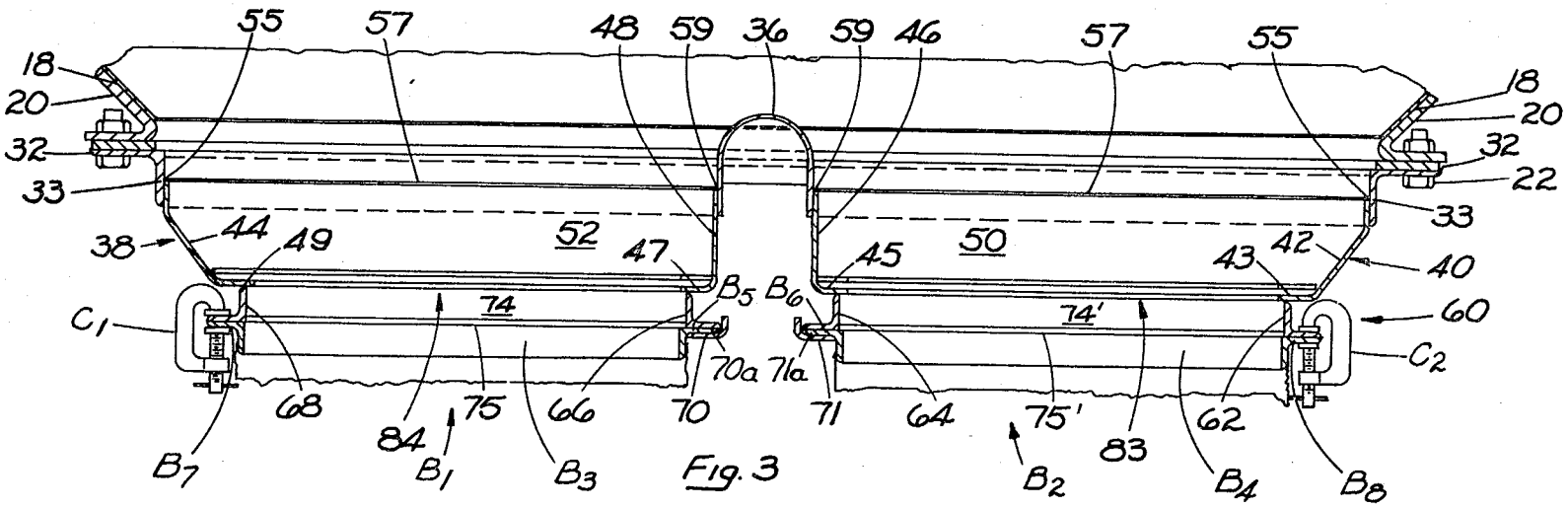
FIG. 3 is a transverse sectional view looking in the direction of the arrows along the line 3—3 in FIG. 2 with the adapter attached to a railway hopper, and sharing a pair of unloading boots attached to the adapter.

As shown in FIG. 1 of the drawings a railway hopper car 10 is provided including a plurality of hoppers 12, separated by transverse bulkheads 13. The roof includes a plurality of hatches 14 for loading the car. The hoppers include hopper slope sheets extending downwardly and inwardly as indicated in 18. An outlet mounting frame 20 is attached to the lower inner edges of the hopper slope sheets 18 (FIG. 3).

An outlet adapter indicated in the drawings generally at 30 includes an adapter mounting flange 32, having a depending leg 33 and openings 34 adapted to receive fasteners 22 for attaching the adapter to the mounting frame 20. The adapter includes a divider 36 which divides the adapter into a pair of transversely spaced adapter discharge outlets or chutes 38 and 40.

The adapter discharge outlets include outer side walls 42 and 44, inclined downwardly and inwardly. In addition, inner side walls 46 and 48 extend vertically downward. End walls 50, 52, 54 and 56 are similarly provided. The side walls 42, 44 and the end walls 50, 52, 54 and 56 are welded to the outlet flange 32 on leg 33 at 55 and 57. The inner walls 46 and 48 are welded to the transverse divider 36 at 59.

Figure 2:
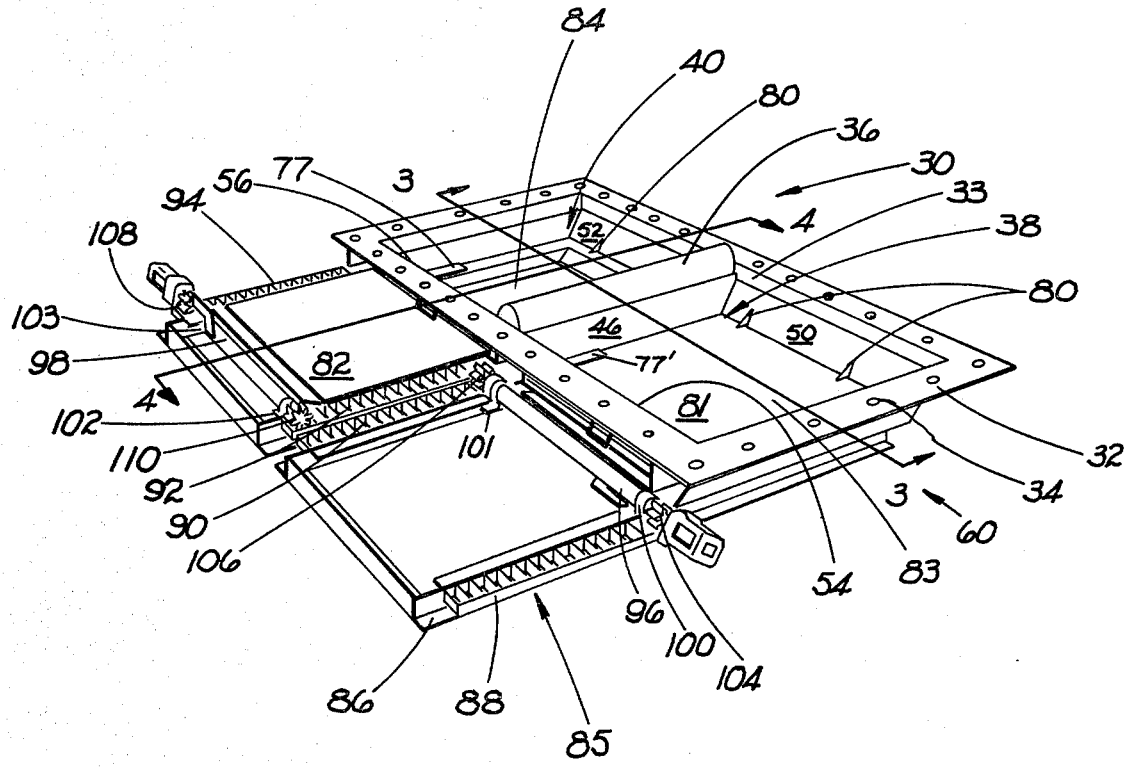
FIG. 2 is a perspective view of the outlet adapter of the present invention removed from the hopper car.
Figure 4:
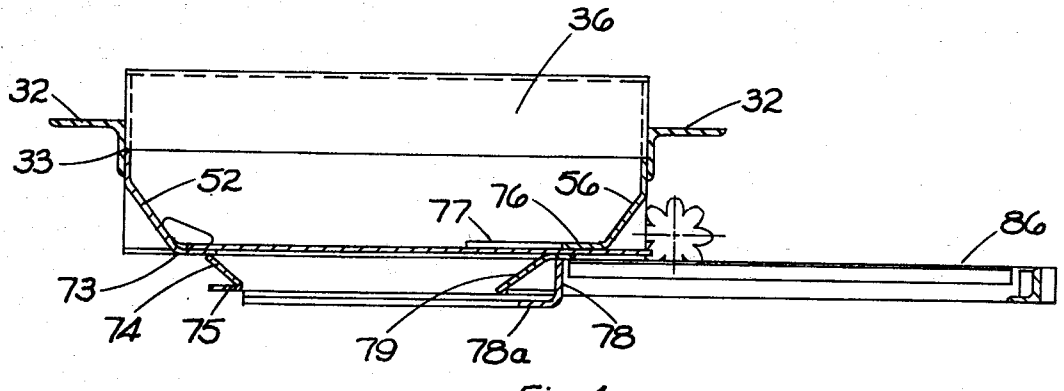
FIG. 4 is a longitudinal sectional view looking in the direction of the arrows along line 4—4 in FIG. 2.

Means for attaching unloading boots to the lower portion of the respective adapter chutes is indicated in the drawings generally at 60. As shown in FIG. 3 this may comprise spaced angles 62, 64, 66 and 68 welded to the respective flanges 43, 45, 47 and 49 of the side walls. In addition, outwardly extending angles 70 and 71 are welded to the inner edges of angles 64 and 66 to define slots 70*a* and 71*a*. End wall 52 has an inwardly extending flange 74 to which is attached a depending leg 74 having an outwardly extending flange 75. End walls 54 and 56 include inwardly directed flanges 76 including inward extensions or gate guides 77, 77[1] at the sides of the outlet. A depending angle 78 has a gate support 79 welded thereto, and includes an inwardly extending flange 78*a*. Thus, a pair of transversely spaced unloading boots, $B_1$ and $B_2$, can be readily attached to the transversely spaced outlets 38 and 40. Boots $B_1$ and $B_2$ are rigidly attached to angles $B_3$ and $B_4$. Angles $B_3$ and $B_4$ have outwardly directed flanges $B_5$ and $B_6$ which fit within slots 70*a* and 71*a*. Angles $B_3$ and $B_4$ also include shorter flanges $B_7$ and $B_8$ which engage angles 62 and 68 and are held in place with clamps $C_1$ and $C_2$. Additionally, gate guides 80 (FIG. 2) are preferably welded to the closed position side of the respective outlets 38 and 40.

A pair of horizontally extending gates 81 and 82 are provided to close the respective discharge openings 83 and 84 in outlet chutes 38 and 40. Means for moving the gates between open and closed positions is indicated in the drawings generally at 85.

In one arrangement this includes a frame 86 having attached thereto respective fixed racks 88, 90, 92 and 94.

Each gate has a pinion shaft 96 or 98, each having a pair of door bearings 100 and 101; 102 and 103 attached at their inner ends to the gate and engaging the pinion shaft with clearance to allow rotation of the respective pinion shafts 96 and 98 with respect to door bearings as the gates are moved between open and closed positions. Pinions 104, 106, 108 and 110 are attached to opposite end portions of pinion shafts 96 and 98. These pinions move respectively along the fixed rack portions 88, 90, 92 and 94 in a known manner to move the respective gates 81 and 82 between open and closed positions.

The outlet arrangement shown in FIGS. 1 through 4 has the advantage that the cross-sectional area which the lading acts upon is approximately half of the cross-sectional area upon which the lading would normally act in the absence of the divider portion 36. Thus the outlet arrangement 30 results in less force required to open the respective gates 81 and 82 than if a single gate were utilized, operating within the outlet adapter 30.

Figure 5:
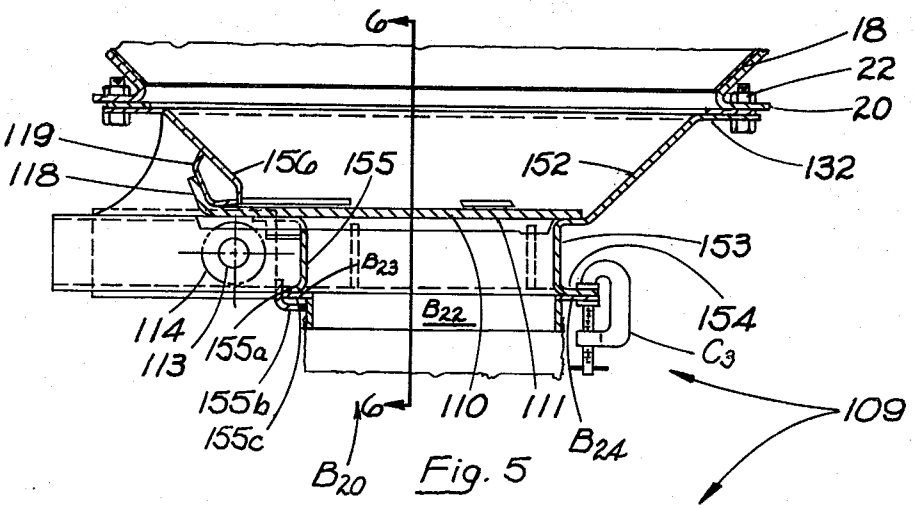
FIG. 5 is a sectional view illustrating an outlet attached to the outlet frame having a single discharge outlet having a movable rack and a fixed but rotatable pinion for moving the gate between open and closed positions.
Figure 6:
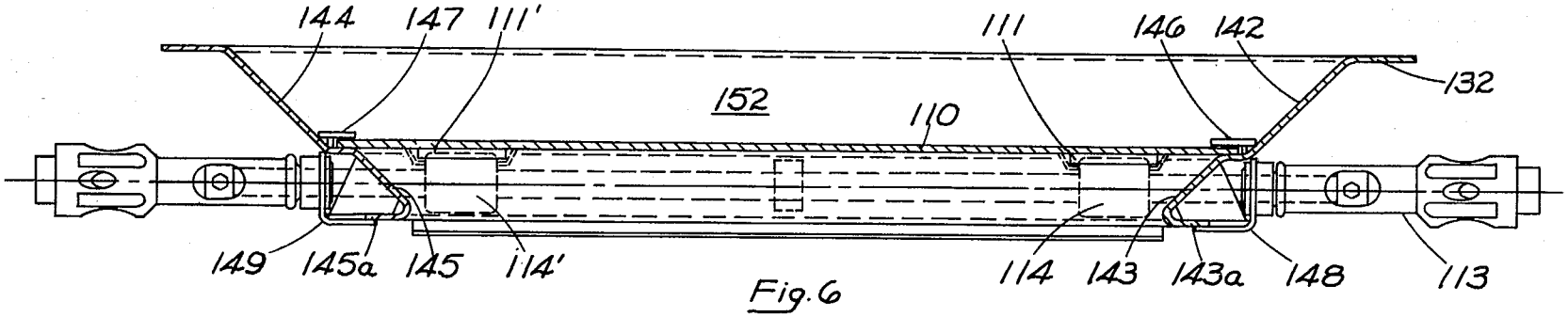
FIG. 6 is a sectional view looking in the direction of the arrows along the line 6—6 in FIG. 5 with the boot removed.

At some unloading sites a single unloading boot only is available. If the car is put into service where it is to be unloaded at such sites, the outlet adapter 30 may be unbolted from the mounting frame 20 and a conventional discharge outlet 109 with a single discharge gate 110 utilized to unload the lading as shown in FIGS. 5 and 6. Examples of such outlets are found in U.S. Pat. No. 3,877,392 and in application Ser. No. 845,603 filed Oct. 26, 1977, both assigned to the same assignee as the present application. In some instances, the gate may be difficult to unload because of the large lading force acting on the gate. However, if the particular unloading site has only one large unloading boot adapted to receive lading discharge, the larger outlet must be used at this unloading site.

Briefly, the outlet 109 includes a mounting flange 132 and fasteners 22 hold the outlet on frame 20. The outlet includes side walls 142 and 144, and end walls 152 and 156. End wall 152 includes a depending extension 153 having an outwardly extending flange 154. Below wall 156 a gate support 155 has an outwardly directed flange 155*a*. An angle 155*b* is welded thereto to define a boot attaching slot 155*c*. An unloading boot $B_{20}$ is attached to an angle $B_{22}$ having outwardly directed flanges $B_{23}$ and $B_{24}$. Flange $B_{23}$ fits within slot 155*c* and flange $B_{24}$ is held in engagement with flange 154 by clamp $C_3$.

Side walls 142 and 144 include extensions 143 and 145 which support a gate 110 for back and front movement between open and closed positions. Extensions 143 and 145 are welded to longitudinal angles 148 and 149. Extensions 143 and 145 each include outwardly directed flanges 143*a* and 145*a*. Gate guides 146 and 147 are supported on extensions 143 and 145

An alternative means for moving the gate between open and closed positions is illustrated in FIGS. 5 and 6. In this arrangement the gate 110 includes depending racks 111, 111[1]. Racks 111 and 111[1] contain rack teeth as is conventional in the art. A pinion shaft 113 having spaced pinions 114, 114[1] is provided. Pinions 114 engage the racks 111 on opposite sides thereof to move the gate 110 between open and closed positions. In closed position an extension of the gate 118 engages a gate stop 119.

What is claimed is:

1. In a railway hopper car having at least one hopper extending transversely between laterally spaced side sills and longitudinally of the car to define a hopper body; said hopper having hopper slope sheets extending downwardly and inwardly; said slope sheets having inner edges of rectangular configuration with the long rectangular dimensions extending transversely of the car; said inner ends having attached thereto an outlet frame of rectangular configuration generally conforming to said inner edges; said frame having a frame mounting flange; a single large outlet having a cross sectional area of substantially the entire area within said frame interchangeably attached to said frame, the improvement comprising:

an interchangeable outlet adapter attachable to said outlet frame; said outlet adapter including a mounting flange conforming to said frame mounting flange and a divider extending longitudinally of the car which divides said adapter into a pair of transversely spaced adapter chutes; said adapter chutes including side walls and end walls, the lower ends of which define transversely spaced chute openings; a generally horizontally extending outlet gate located in each adapter chute; means for moving each of said gates between open and closed positions relative to each adapter chute opening; said chutes further including boot attachment means located below each chute for attachment of an unloading boot to each chute.

2. A railway hopper car unloading arrangement according to claim 1 wherein the boot attachment means comprise legs depending downwrdly from said adapter having outwardly extending boot attachment flanges attached to said depending legs.

3. A railway hopper car unloading arrangement according to claim 2 wherein slots are defined by vertically spaced angles that receive boot attachment flanges for unloading through said boots.

4. A hopper unloading arrangement according to claim 3 wherein removable fasteners also maintain said boots in unloading position.

5. A hopper unloading arrangement according to claim 4 wherein said removable fasteners comprise clamps.

6. In a railway hopper car having at least one hopper extending transversely between laterally spaced side sills and longitudinally of the car to define a hopper body; said hopper having hopper slope sheets extending downwardly and inwardly; said slope sheets having inner edges of rectangular configuration with the long rectangular dimensions extending transversely of the car; said inner edges having attached thereto an outlet frame of rectangular configuration generally conforming to said inner edges; said frame having a frame mounting flange; a single large outlet having a cross sectional area of substantially the entire area within said frame interchangeably attached to said frame, the improvement comprising:

an interchangeable outlet adapter attachable to said outlet frame, said outlet adapter including a mounting flange conforming to said frame mounting flange and a divider extending longitudinally of the car which divides said adapter into a pair of transversely spaced adapter chutes; said adapter chutes including side walls and end walls, the lower ends of which define transversely spaced discharge openings; a generally horizontally extending outlet gate located in each adapter chute; means for moving each of said gates between open and closed positions relative to each adapter chute opening; said chutes further including boot attachment means located below each chute for attachment of an unloading boot to each chute; the force of lading friction opposing movement of one of said gates to open position being reduced as compared to the force of lading friction opposing opening of a single outlet having a cross sectional area of substantially the entire cross sectional area within said frame.

* * * * *

UNITED STATES PATENT AND TRADEMARK OFFICE

CERTIFICATE OF CORRECTION

PATENT NO. : 4,207,822

DATED : June 17, 1980

INVENTOR(S) : James R. Zimmerle, et.al.

It is certified that error appears in the above-identified patent and that said Letters Patent are hereby corrected as shown below:

Front page, Abstract, line 11, delete "or chutes".
Front page, Abstract, line 13, "chutes" should read --discharge openings--.
Front page, Abstract, line 16, "chute" should read --discharge opening--.
Column 1, line 5, after "outlets" insert --or chutes--.
Column 1, line 14, "discharge openings" should read --chutes--.
Column 1, line 17, "discharge opening" should read --chute--.
Column 3, line 6, "74" should read --73--.

Signed and Sealed this

*Thirteenth* Day of *January 1981*

[SEAL]

*Attest:*

SIDNEY A. DIAMOND

*Attesting Officer*

*Commissioner of Patents and Trademarks*